US006659366B1

(12) United States Patent
Walters

(10) Patent No.: US 6,659,366 B1
(45) Date of Patent: Dec. 9, 2003

(54) HAND HELD WATER MISTING APPARATUS

(76) Inventor: Philip Todd Walters, 328 S. 300 E. #6, St. George, UT (US) 84770

( * ) Notice: Subject to any disclaimer, the term of this patent is extended or adjusted under 35 U.S.C. 154(b) by 0 days.

(21) Appl. No.: 10/163,247

(22) Filed: Jun. 4, 2002

(51) Int. Cl.[7] ..... B05B 9/08

(52) U.S. Cl. ..... 239/152; 239/289; 239/327; 239/328; 239/375; 239/569; 222/206; 222/210; 222/212

(58) Field of Search ..... 239/289, 152, 239/153, 154, 211, 16, 327, 328, 337, 375, 435, 533.1, 533.15, 547, 569; 222/206, 210, 212, 215; 137/613; 251/4, 9, 10

(56) References Cited

U.S. PATENT DOCUMENTS

| | | | | | |
|---|---|---|---|---|---|
| 1,959,782 | A | * | 5/1934 | Fenwick, Jr. | 239/154 |
| 2,511,486 | A | * | 6/1950 | Thames | 239/542 |
| 3,848,808 | A | * | 11/1974 | Fetty et al. | 239/327 |
| 4,097,020 | A | * | 6/1978 | Sussman | 251/10 |
| 4,735,239 | A | | 4/1988 | Salmon | 141/25 |
| D308,897 | S | | 6/1990 | Briski | D21/145 |
| 5,174,477 | A | | 12/1992 | Schafer | 222/183 |
| 5,535,951 | A | | 7/1996 | Utter | 239/322 |
| 5,620,140 | A | | 4/1997 | Utter | 239/153 |
| 5,622,056 | A | | 4/1997 | Utter | 62/121 |
| 5,775,590 | A | | 7/1998 | Utter | 239/152 |
| 6,481,642 | B1 | * | 11/2002 | Louis et al. | 239/152 |

* cited by examiner

*Primary Examiner*—Robin O. Evans

(57) ABSTRACT

A novel hand held water-misting apparatus (8) comprising of a latex tubing (10) having a first end and a second end, a valve open-close type (12) having a first end and second end, a misting nozzle (14) having a first end and a second end having a small misting hole, a shrink sleeving (28) securely attaching said valve open-close type (12) and said misting nozzle (14), a water hose connector (16), a flexible strap (26) having a first end and a second end, a pinch clip (24) having an open position and a closed position, an expandable decorative enclosure (18) having a first end and a second end. Said first end of said latex tubing (10) securely attached to said first end of said valve open-close type (12) by a tie clamp (31). Said second end of said latex tubing (10) securely attached to said water hose connector (16) by a tie clamp (30). Said pinch clip (24) placed over said latex tubing (10) and said expandable decorative enclosure (18) having said first end securely attached to said first end of said valve open-close type (12) by a tie clamp (20) and having said second end of said expandable decorative enclosure (18) securely attached to said water hose connector (16) by a tie clamp (22).

7 Claims, 3 Drawing Sheets

28
14
12
20
31
18
26
8
10
24
30
22
16

HAND HELD WATER MISTING APPARATUS

BACKGROUND

1. Field of Invention

This invention relates in general to water misting apparatus, in particular to a hand held water-misting apparatus, which is used for cooling off a person during a hot day as well as misting plants, etc. This invention is made of multiple parts having the ability to mist any part of the human body. When not in use, may be carried by the flexible strap around the neck of the individual.

2. Description of Prior Art

Prior art misting apparatuses are very elaborate in construction, which have the capability of making the cost much higher. The difficulties with the prior art apparatuses, are that they need a pump for pressurizing the container or bladder, a flow regulator, thereby, an examination of prior art misting apparatus clearly discloses that containers or bladders which holds the water are pressurized by either motor power, air pressure directly applied to the water chamber or manual pumping.

Another type portable mist cooling device consisting of a pressurizable container, a valve for activating the release of water from the container, a spray nozzle or a plurality of spray nozzles coupled to the valve, a pump for pressurizing the water container, a belt for securing the portable mist cooling device in a hands-free manner. Therefore, this device has a manual air pump for pressurizing the water container.

Another type misting apparatus consisting of a pressurizable tank, a valve activating the release of water from the pressurizable tank, a spray nozzle or a plurality of spray nozzles coupled to the valve by a quick connect coupler. The spray nozzle is coupled to a flow regulator valve which regulates the gas coming from the pressurizable gas chamber. Therefore, this prior art needs pressurized gas which makes the usefulness greatly limited and much more costly to manufacture.

Another type portable mist cooling device consisting of a pressurizable container, valve for activating the release of water from the container, a spray nozzle or a plurality of spray nozzles coupled to the valve, a pump for pressurizing the container, a belt for securing the device to a person, and a clip for attaching the mist nozzle in such a fashion that it directs the flow of mist in a hands free manner. This prior art requires a manual air pump for pressurizing the water tank.

Another type misting apparatus consisting of a pressurizable tank, a valve for activating the release of water from the pressurizable tank, and a spray nozzle or a plurality of spray nozzles coupled to the valve by a quick connect coupler. This prior art requires the outer housing to be charged with gas which impinges upon the resilient water bladder.

Another type is a water squirt toy which has the capability to squirt water only. This prior art is not a misting device or apparatus.

Another type is a toy squirt bladder or similar article. This prior art is only an ornamental design for a toy squirt bladder or similar article. It is not a misting device or apparatus.

Another type liquid projecting device, this prior art is a water-projecting toy to be held by user. This is not a mist device or apparatus. Its design is to be a water-projecting toy for squirting the water and not used as a mist cooling device or apparatus.

OBJECTS AND ADVANTAGES

Accordingly, besides the objects and advantages described above, several objects and advantages of the present invention are:

(a) to provide a misting apparatus that is much more compact, and a more simplistic design than the prior art.

(b) to provide a misting apparatus less expensive to construct than the prior art.

(c) to provide a misting apparatus that does not require a pump to pressurize the water bladder.

(d) to provide a misting apparatus that can be pressurized by a simple water hose.

(e) to provide a misting apparatus when not in use to be placed around the neck of the user until needed.

(f) to provide a water misting apparatus when in use to be safe having an enclosure to protect the user if the latex tubing should burst.

It is the feature of the present invention that it provides a misting apparatus comprising latex tubing as the water container when pressurized from a water hose source will expand causing pressure to build up on the inside of the latex tubing, thereby, not needing a manual pump or motorized pump or no need for gas or air pressure to pressurize the water container. The said latex tubing having a first end and second end, a valve open-close type having a first end and second end. The said valve open-close type first end is securely attached to the first end of said latex tubing by a tie clamp. Misting nozzle having a first and a second end. Said misting nozzle first end is securely attached to the second end of the said valve by shrink sleeving having a first end and a second end. The second end of the said shrink sleeving is placed over the second end of said valve and the first end of said shrink sleeving is placed over the first end of said misting nozzle. Heat is applied to the said shrink sleeving causing it to tighten firmly around said misting nozzle and said valve. A pinch clip is installed over and near the second end of said latex tubing with the up-right end having teeth of said pinch clip towards the second end of said latex tubing. A water hose connector is securely attached to said latex tubing second end by a tie clamp. A flexible strap having a first end and a second end. Said flexible strap first end to be attached in top hole of said valve and the second end of said flexible strap attached in smaller upper hole on said pinch clip. An expandable decorative enclosure having a first end and a second end. Said first end of said expandable decorative enclosure to be attached to first end of said valve by a tie clamp. Said expandable decorative enclosure to be pulled through the larger lower hole on the slanted part of said pinch clip and through the hole in the up-right of said pinch clip and attached to the said water hose connector by a tie clamp.

It is an object of the present invention to provide an improved misting apparatus.

Other objects and features are readily apparent from the following description of certain preferred embodiments thereof taken in conjunction with the accompanying drawings although variations and modifications may be affected without departing from the sphere and scope of the normal concepts of the disclosed invention. You will find further objects and advantages of the invention from a consideration of the ensuing descriptions and accompanying drawings.

DRAWING FIGURES

FIG. 1 Shows a side view of the misting apparatus with the pinch clip in the open position. Latex tubing not under pressure. With applicable end call outs.

Figure 1:
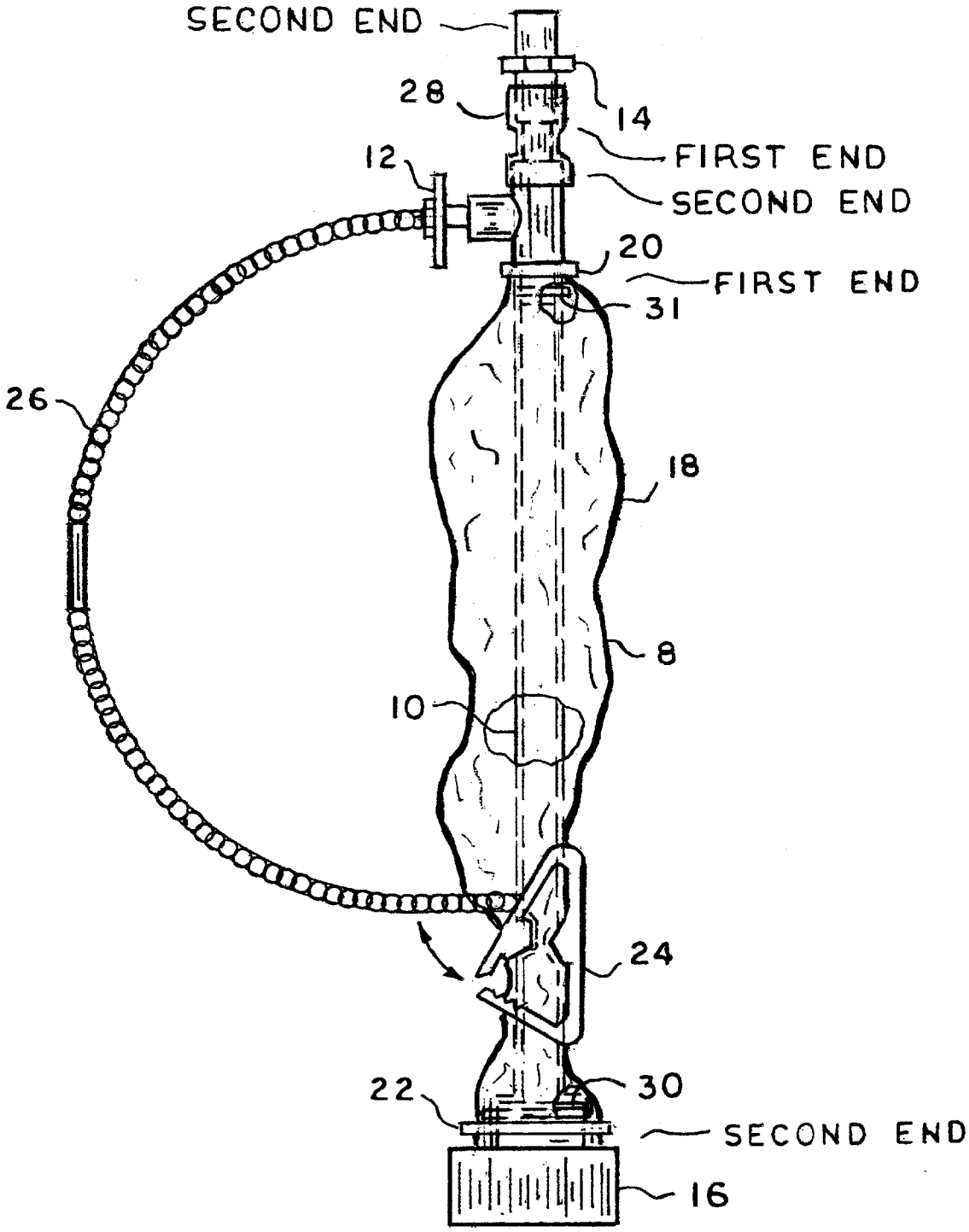

DRAWING REFERENCE NUMERALS:

8 hand held water misting apparatus
10 latex tubing
12 valve open-close type
14 misting nozzle
16 water hose connector
18 expandable decorative enclosure
20 tie clamp
22 tie clamp
24 pinch clip
26 flexible strap
28 shrink sleeving
30 tie clamp
31 tie clamp

DESCRIPTION OF INVENTION

Figure 2:
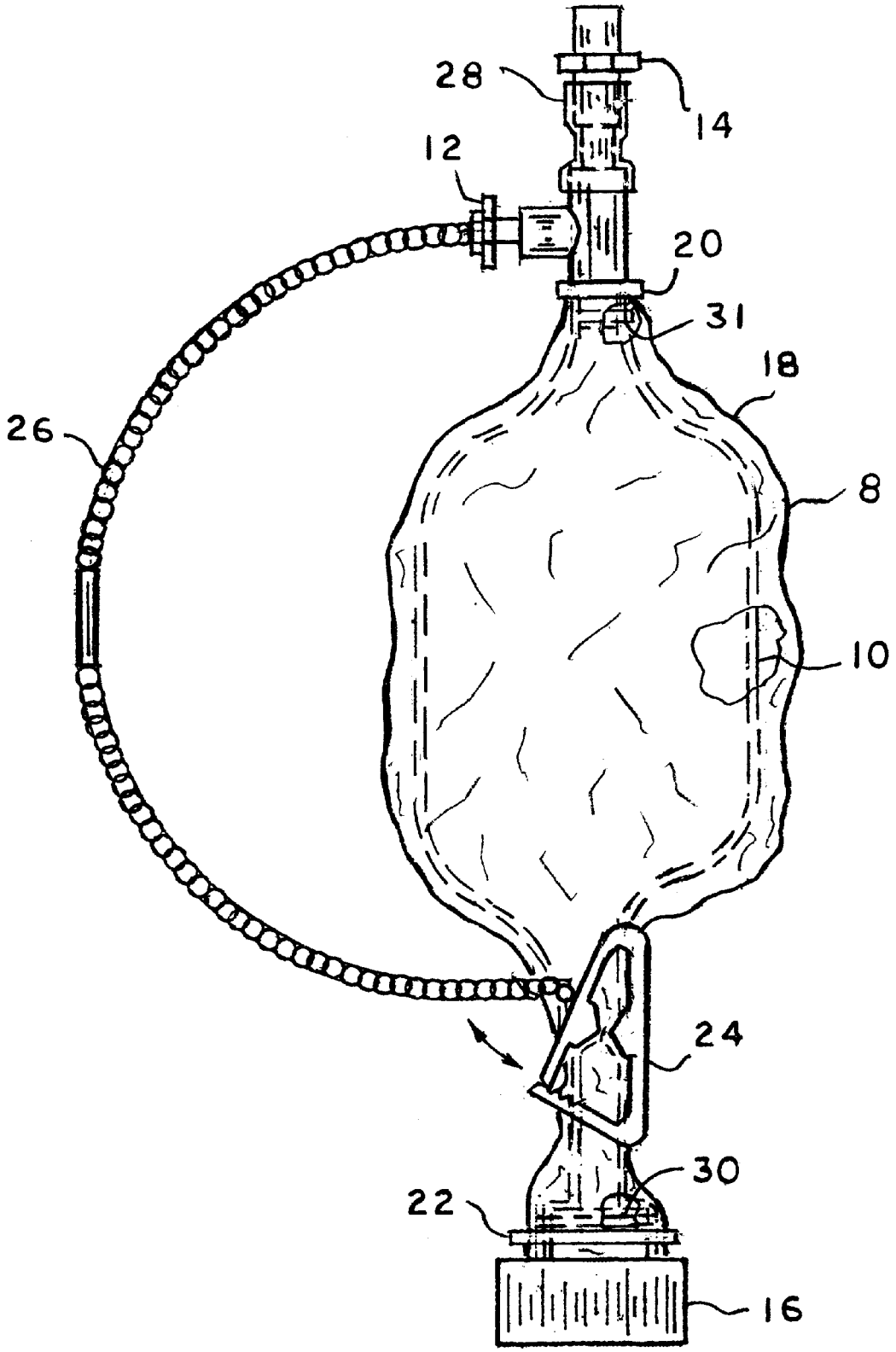
FIG. 2 Shows a side view of the misting apparatus with the pinch clip in the closed position. Latex tubing under pressure.
Figure 3:
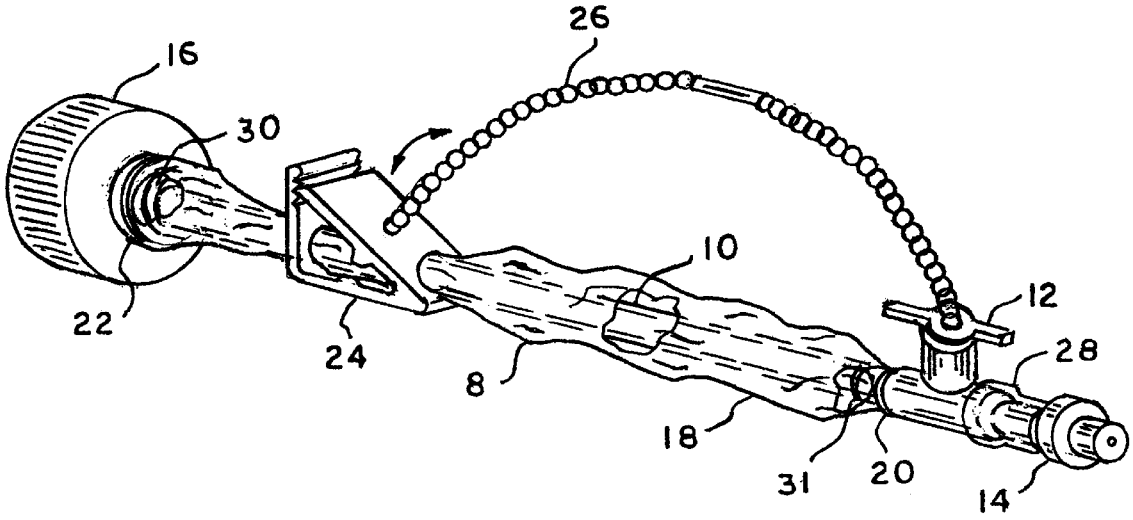
FIG. 3 Shows a perspective view of a misting apparatus in accordance with the invention.
Figure 4:
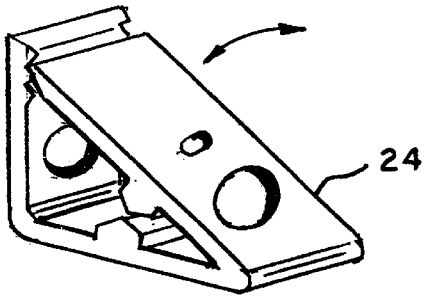
FIG. 4 Shows a perspective view of the pinch clip.

The hand held water-misting apparatus shown in FIG. 1, FIG. 2, FIG. 3 and pinch clip FIG. 4, comprises of a latex tubing 10, having sufficient thickness, width and length, having a first end and a second end a valve open-close type 12, having a first end and a second end. The said valve open-close type 12 first end is securely attached to the first end of said latex tubing 10, by a tie clamp 31. A misting nozzle 14, having a first end and a second end having a small mist hole. Said misting nozzle 14, first end if securely attached to the second end of the said valve open-closed type 12, by shrink sleeving 28, causing it to tighten firmly around said misting nozzle 14, and said valve open-closed type 12. A pinch clip 24, is installed over and near the second end of said latex tubing 10, with the up-right end having teeth of said pinch clip 24, towards the second end of said latex tubing 10. A water hose connector 16, is securely attached to said clamp 30. A flexible strap 26, having a first end and a second end. Said flexible strap 26 first end to be attached in top hole of said valve open-close type 12, and the second end of said flexible strap 26 to be attached through the smaller upper hole on said pinch clip 24. An expandable decorative enclosure 18, to be attached to first end of said valve open-close type 12, by a tie clamp 20. Said expandable decorative enclosure 18, to be pulled through the larger lower hole located on the slanted part of the said pinch clip 24, and through the hole in the up-right of said pinch clip and attached to said water hose connector by a tie clamp 22.

Conclusion and Scope of Invention

Accordingly, the reader will see that the hand held water-misting apparatus oft his invention has the ability to be portable, simplistic and less costly to manufacture. Furthermore, the hand held water-misting apparatus has the additional advantages in that:

- it provides no need for an air pump manual or motorized.
- it provides no need for a gas pump manual or motorized.
- it permits the user to use a simple water hose source to pressurize the latex tubing.
- it provides compactness allowing the hand held water-misting apparatus to be a smaller configuration.
- it provides a flexible strap for the user of the hand held water-misting apparatus when not in use to place it around his neck until needed.
- it provides a very decorative water-misting apparatus.

Although the description above contains many specifications, these should not be construed as limiting the scope of the invention but merely providing illustrations of some of the presently preferred embodiments of this invention. For example, the hand held water-misting apparatus having a latex tubing that expands as the water source is used to pressurize the water inside the latex tubing, thereby not requiring a manual or motorized pump. The latex tubing may be of other shapes, such as square, oval, trapezoidal, triangular, etc. The mechanical devices such as the pinch clip, expandable decorative enclosure, flexible strap, tie clamps, shrink sleeving can be of different combinations and materials.

Thus, the scope of the invention should be determined by the appended claims and their legal equivalents, rather than by the examples given.

I claim:

1. A hand held water-misting apparatus which comprises a latex tubing having sufficient thickness, width and length having a first end and a second end, a valve open-close type having a first end and a second end, a misting nozzle having a first end and a second end having a small misting hole, a water hose connector, a flexible strap having sufficient thickness, width and length having a first end and a second end, a pinch clip having an open position and a closed position, an expandable decorative enclosure having sufficient thickness, width and length having a first end and a second end.

2. The hand held water-misting apparatus of claim 1 wherein said first end of said latex tubing securely attached to said first end of said valve open-close type by a tie clamp having sufficient thickness, width and length.

3. The hand held water-misting apparatus of claim 1 wherein said first end of said misting nozzle and said second end of said valve open-close type securely attached by placing shrink sleeving having sufficient thickness, width and length over said first end of said misting nozzle and said second end of said valve open-close type.

4. The hand held water-misting apparatus of claim 1 wherein said pinch clip is installed over and near said second end of said latex tubing with the up-right part having locking teeth of said pinch clip towards said second end of said latex tubing.

5. The hand held water-misting apparatus of claim 1 wherein said water hose connector securely attached to said second end of said latex tubing by a tie clamp having sufficient thickness, width and length.

6. The hand held water-misting apparatus of claim 1 wherein said first end of said flexible strap securely attached in top hole of said valve open-close type of said second end of said flexible strap securely attached through the smaller upper hole on slanted part of said pinch clip.

7. The hand held water-misting apparatus of claim 1 wherein said first end of said expandable decorative enclosure securely attached to said first end of said valve open-close type by a tie clamp and said second end of said expandable decorative enclosure pulled through large hole located on the slanted part of said pinch clip and through the hole located on the up-right part of said pinch clip and securely attached to said water hose connector by a tie clamp having sufficient thickness, width and length.

* * * * *